United States Patent [19]

Klein et al.

[11] Patent Number: 4,511,052

[45] Date of Patent: Apr. 16, 1985

[54] CONTAINER SEAL WITH TAMPER INDICATOR

[76] Inventors: Howard J. Klein, 14212 Matisse Ave., Irvine, Calif. 92714; Gabor L. Szekeres, 18082 Dorchester Cir., Villa Park, Calif. 92667

[21] Appl. No.: 471,870

[22] Filed: Mar. 3, 1983

[51] Int. Cl.[3] ..... B65D 55/02

[52] U.S. Cl. ..... 215/230; 215/232; 206/807

[58] Field of Search ..... 206/807, 459; 215/365, 215/230, 232; 220/359, 214

[56] References Cited

U.S. PATENT DOCUMENTS 3,899,295 8/1975 Halpern ..... 206/459 X
3,923,198 12/1975 Brochman ..... 220/359
4,407,429 10/1983 Hekal ..... 220/359
4,424,911 1/1984 Resnick ..... 206/459 X

*Primary Examiner*—Donald F. Norton
*Attorney, Agent, or Firm*—Klein, Szekeres & Fischer

[57] ABSTRACT

A container assembly is disclosed which incorporates a chemical indicator normally hermetically sealed from the ambient atmosphere, but exposed to the atmosphere upon opening of the container assembly. The indicator is adapted for changing appearance, either color or granule or crystal form, upon exposure to moisture or oxygen. The indicator is either located in the interior of a hermetically sealed container, or is sealed in a frangible envelope which is operatively associated with a closure member of the container and is ruptured upon opening, or attempted opening of the container.

15 Claims, 5 Drawing Figures

CONTAINER SEAL WITH TAMPER INDICATOR

BACKGROUND OF THE INVENTION

1. Field of the Invention

The present invention relates broadly to the field of sealing means for packages and containers. More specifically, the invention relates to a sealing device or for a bottle, can, or jar, which includes means for indicating that the seal has been previously removed and replaced.

2. Brief Description of the Prior Art

Recent events have focused increased interest in so-called "tamper-resistant" packaging for various commodities, particularly those made for ingestion or topical application by humans. To date, a number of approaches have been tried, with varying degrees of success. For example, bottles and jars and the like have been made with paper or foil inner seals glued around the edges of the container's mouth. Another common approach has been to provide a peripheral seal of plastic or the like, around the cap or stopper of the container. Still another approach is the use of a cap or stopper frangibly connected to a ring around the neck of the container.

The foregoing concepts have been trade-offs among the often competing criteria of cost, convenience of use and integrity of the seal. Thus, the inner seal, while convenient and inexpensive, provides little security for containers carrying liquid products, which can be contaminated through the seal by a hypodermic needle. The frangible-ring concept, while offering better security, is more expensive to fabricate. The peripheral seal approach shares the convenience and economy of the inner seal. However, as with the inner seal, the peripheral seal can be removed, (although with difficulty by elderly or infirm people) and either the original seal or one similar to it can be used to reseal the container after it has been opened, with only a moderate amount of effort.

There has thus been recognized a need for a sealing device which combines economy of manufacture, convenience of use and good sealing integrity, and which further provides a good degree of security against efforts to reseal the package once it has been opened.

SUMMARY OF THE INVENTION

Broadly, the present invention comprises a strip of sealing material which, like the aforementioned peripheral seal, is adhesively attached around the periphery of the cap or stopper, thereby sealing the cap or stopper to the neck or body of the container. This peripheral seal is combined, in a unique fashion, with a chemical indicator, of the type which undergoes a marked change in color or form when exposed either to oxygen or water vapor, in the proportions normally present in the ambient atmosphere. In a preferred embodiment, the chemical indicator is contained in a small clear envelope having a frangible wall. The envelope is attached to the jar or bottle underneath the peripheral sealing band, such that removal of the seal breaks the frangible wall and exposes the indicator to the environment. The color or form change which the indicator undergoes thereby offers positive evidence that the seal has been removed. In an alternative embodiment, suitable for use with clear plastic or glass bottles or jars containing pills, capsules, and the like, the indicator is applied to the inside of the bottle so that it undergoes a visible color or form change when the stopper or cap is removed. The indicator is, of course, positioned so that its color and/or form can easily be discerned from the outside.

With either embodiment, the indicator's color offers an easy confirmation of whether or not the package has ever been previously opened or unsealed. The color or form change of the indicator is permanent, surviving any resealing of the container, no matter how skillfully done. By means of notices on the container, the consumer can be warned not to use the contents if the indicator shows anything other than a given color or form, or if the indicator is missing.

Thus, it will be seen that the present invention provides a sealing mechanism which combines the convenience and economy of manufacture of the inner seal and peripheral seal devices, while adding an extra degree of security.

DETAILED DESCRIPTION OF THE INVENTION

Figure 1:
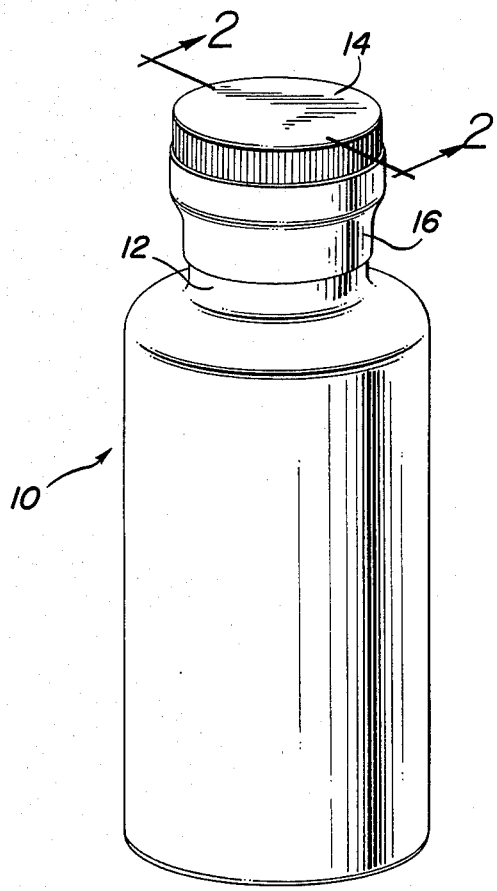
FIG. 1 is a perspective view of a bottle incorporating a sealing device in accordance with the preferred embodiment of the present invention.
Figure 2:
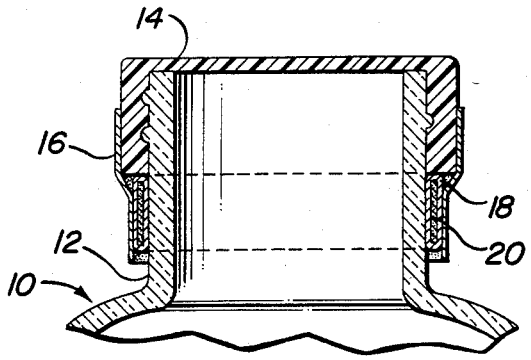
FIG. 2 is a cross-sectional view taken along line 2—2 of FIG. 1.
Figure 3:
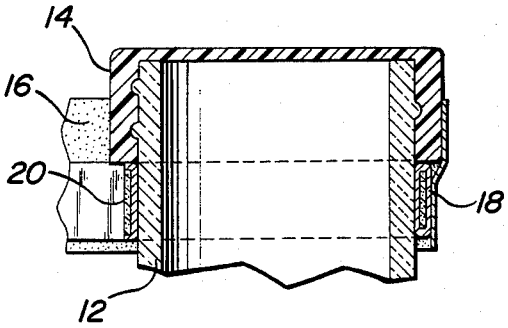
FIG. 3 is a cross-sectional view, as in FIG. 2, but showing the sealing device as it is being removed.

As shown in FIGS. 1, 2, and 3, a container, such as a bottle 10, having a threaded neck 12, is shown with a sealing device in accordance with a first preferred embodiment of the present invention. The bottle 10 is closed by conventional closure means, such as a threaded cap 14, and may be opaque (as shown), translucent, or transparent.

A tightly fitting strip or band 16 of sealing material, such as plastic, is applied around the cap 14 and the neck 12, sealing the former onto the latter. The band 16 is of conventional design and construction, and need not be described in great detail. It is important, however, for reasons which will presently be made apparent, that the strip 16 be substantially transparent.

As shown in FIGS. 2 and 3, an annular envelope 18 is adhesively attached around the neck 12 of the bottle 10. The envelope 18 is actually a flattened tube of a tearable material, such as a suitable plastic in the form of a thin film, and it contains a chemical indicator 20. The indicator 20 is a chemical substance, or a mixture of chemical substances, of the type which undergo a marked change of color when exposed to one of the common components of the ambient atmosphere, such as oxygen or water vapor.

It is preferable that the indicator chemical substance or substances be either of solid materials, or be capable of being provided on a solid support within the envelope 18. Chemical compositions which are suitable for inclusion in the envelope as suitable indicators include inorganic materials which undergo a color change when water is incorporated in the crystals as crystal water. Copper sulfate which is substantially colorless in a dry, (anhydrous) form, and deep blue when hydrated in its crystal structure, or in solution, is an example of a suitable chemical indicator. Another example is cobalt chloride which is blue in an anhydrous water free state, and red in a hydrated state. There are still many other inorganic chemicals which undergo a color change upon hydration from moisture in the atmosphere, and therefore are useful as indicators in the present invention.

Other suitable chemical indicating compositions include anhydrous mixtures of a solid acidic or basic substance, intimately mixed with an organic acid-base indicator dye. This mixture is preferably strongly diluted by a suitable neutral, solid material, or is disposed on a solid support. In this example, the acid-base indicator undergoes a color change only when moisture has been absorbed from the atmosphere to dissolve the acidic or basic substance and thereby "expose" the indicator dye to the acid or base. A specific example of the just-noted type of chemical indicator composition 20 is anhydrous, powdered sodium carbonate (basic substance), an acide-base indicator dye such as litmus, phenolphtalein or methyl-orange (sodium p-dimethylamino azo benzene sulfonate) and a suitable support such as a cotton pad or a neutral solid powder. Methyl orange is yellow in a basic medium and orange in acidic medium, phenolphtalein is colorless in neutral or acidic medium, and red in basic medium.

Still other indicator compositions include inorganic, and perhaps more importantly, organic dyes. For example leuko-dyes which undergo oxydation to form a visibly colored dye may be used in the present invention. Another specific example of an organic chemical that is suitable for use as an indicator composition in the present invention is an alkaline solution of pyrogallol which is on a suitable solid support, such as a neutral powder, or a cotton pad, within the envelope 18. Alkaline pyrogallol is colorless in the absence of oxygen, but turns virtually black when exposed to oxygen.

Generally speaking, there is a vast number of suitable chemicals or chemical reactant pairs which undergo a visible color change due to a chemical reaction, or hydration, when exposed to atmospheric moisture or oxygen. In the event that the chemical indicator composition contained in the envelope requires uptake of moisture for color change, the indicator composition may also contain an additional hygroscopic agent, such as anhydrous calcium chloride, phosphor pentoxide or anhydrous calcium sulfate, to speed uptake of atmospheric moisture.

Moreover, since the purpose of the invention is to provide a visual indicator to show that the indicator 20 in the envelope 18 had been exposed to the ambient atmosphere, a change in color although preferred, is not absolutely necessary. Certain hygroscopic chemicals are readily formed into an anhydrous powder, which becomes lumpy or sticky, or otherwise visibly changes form when exposed to the ambient atmosphere even for a brief period of time. Such chemicals are, for example, anhydrous phosphorous, pentoxide and calcium chloride. These chemicals are also suitable for use as indicators in the present invention.

Referring now again to FIGS. 2 and 3, it is noted that the envelope 18 is also adhesively attached to the transparent outer seal, strip or band 16. It should already be apparent from the foregoing that removal of the strip or band 16 necessarily breaks the thin walled, frangible annular envelope 18, thereby exposing its contents to the atmosphere. Exposure to the atmosphere causes a color or form change in the indicator 20 in a manner described above. As a result of this color or form change, tampering with the bottle is readily detected by a potential user of the contents of the bottle 10. Thus, the bottle 10 becomes highly tamper resistent, or substantially tamper-proof.

Figure 4:
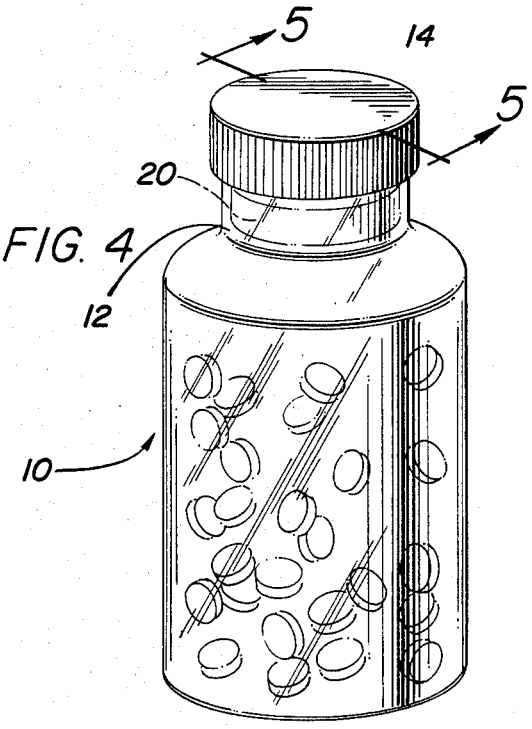
FIG. 4 is a perspective view of a bottle incorporating a sealing device in accordance with an alternative embodiment of the present invention.
Figure 5:
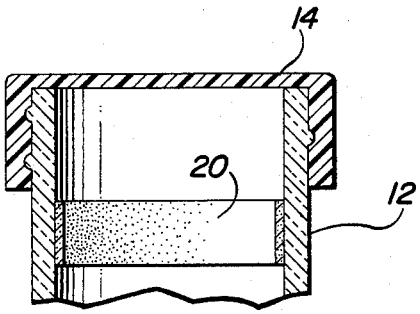
FIG. 5 is a cross-sectional view taken along line 5—5 of FIG. 4.

Referring now to FIGS. 4 and 5, a second preferred embodiment of the present invention is disclosed. In the second preferred embodiment, a chemical indicator composition 20 is disposed in the interior of bottle 10 preferably supported by the cap, stopper, or plug 14 of the bottle 10. The chemical indicator composition 20 is of the type described above in connection with the first preferred embodiment. In this embodiment however, special care must be taken that the indicator 20 should not be toxic so as to dangerously contaminate the contents of the bottle 10. In order to keep the ambient atmosphere out of contact with the indicator 20, the cap 14 may be surrounded by an air-tight seal (not shown).

As it should be apparent from the foregoing, when the bottle 10 of the second preferred embodiment is opened, the indicator 20 changes color or form, so that tampering is again readily detected visually.

It is further apparent friom the foregoing description, that care must be exercised in packing the bottle 10 of the second preferred embodiment of the present invention in such a manner that the chemical indicator 20 is not exposed to atmospheric moisture or oxygen, depending on the nature of the indicator 20. In other words, the bottle 10 must be filled in a moisture or oxygen free environment.

In light of the foregoing it will be readily appreciated by those skilled in the art, that the first preferred embodiment of the present invention offers a very significant advantage, in that the chemical indicator 20 itself is sealed in the annular envelope 18 in an airtight manner, independently from the interior of the container 10. Thus, only the manufacture of the sealed envelopes 18 must be conducted in a moisture free or oxygen free (whichever is applicable) environment. This is, of course, accomplished at a much lower cost than filling the container 10 in the requisite moisture or oxygen free environment.

Since several modifications of the present invention may become readily apparent to those skilled in the art, in light of the above disclosure, the scope of the invention should be interpreted solely from the following claims.

What is claimed is:

1. A sealing device for a container having removable closure means placed on a neck of the container, comprising:

a peelable band sealingly engaging the periphery of said closure means;

a hermetically sealed frangible envelope disposed between the neck of the container and the peelable band and being adhesively attached to both the band and the neck, and indicating means, for changing appearance in response to exposure to the ambient environment, contained within the sealed frangible envelope whereby the removal of said band ruptures the sealed envelope and exposes said indicating means to the ambient environment, the resultant change of appearance being visible from exterior of the container.

2. The device of claim 1, wherein the frangible envelope is transparent and has a frangible wall which is ruptured upon removal of said band.

3. The device of claim 2, wherein said band is transparent at least in the proximity of said indicating means.

4. The device of claim 1, wherein said indicating means changes appearance in response to exposure to oxygen.

5. The device of claim 1, wherein said indicating means changes appearance in response to exposure to water vapor.

6. The device of claim 1 wherein the indicating means comprise a chemical in a substantially anhydrous state, the chemical being capable of changing color upon absorption of moisture from the ambient atmosphere.

7. The device of claim 1 wherein the indicating means comprises an acid-base indicator dye and a chemical selected from a group consisting of an acid and base, said chemical being substantially in an anhydrous state and capable of causing a visible color change in the acid-base indicator upon uptake of moisture from the ambient atmosphere.

8. A sealing device for a container having removable closure means mounted upon a neck of the container, comprising:

a removable band sealingly engaging the closure means, and having at least a transparent portion;

a substantially annular frangible envelope having a transparent wall and a substantially hermetically sealed interior, the envelope being attached to the removable band at least partially beneath the transparent portion and attached to the container so that removal of the band ruptures the envelope and exposes its interior to the ambient atmosphere, and chemical indicating means contained in the envelope and responsive to exposure to the ambient atmosphere for visibly changing appearance due to such exposure.

9. The device of claim 8 wherein the envelope is a substantially flat tube having thin plastic walls.

10. The device of claim 8 wherein the envelope is adhesively attached to the band.

11. The device of claim 8 wherein the envelope is adhesively attached to the neck of the container.

12. The device of claim 8 wherein the indicating means are responsive to oxygen.

13. The device of claim 8 wherein the indicating means are responsive to water.

14. A substantially tamper proof container assembly for foodstuff, medicine and the like, comprising:

a container;

closure means for sealing the container, and chemical indicator means normally isolated from exposure to the ambient atmosphere by being enclosed in frangible and at least partially transparent hermetically sealed envelope means adhesively attached to the exterior of the container and to the closure means, the envelope means being ruptured by removal of the closure means, the chemical indicator means being adapted for being exposed to the atmosphere upon opening of the closure means of the container by rupture of said envelope means, and for visibly changing appearance upon exposure to the ambient atmosphere.

15. The container assembly of claim 14 wherein the indicator means are adapted for changing color upon exposure to the ambient atmosphere.

* * * * *